US005105479A

United States Patent [19]

Ross

[11] Patent Number: 5,105,479

[45] Date of Patent: Apr. 21, 1992

[54] SIMPLE LOW COST MEANS FOR VENTING A WATER CLOSET

[76] Inventor: Dan E. Ross, 308 Almaville Rd., Smyrna, Tenn. 37167

[21] Appl. No.: 632,404

[22] Filed: Dec. 19, 1990

[51] Int. Cl.[5] ..... E03D 9/052

[52] U.S. Cl. ..... 4/213

[58] Field of Search ..... 4/213, 217, 216

[56] References Cited

U.S. PATENT DOCUMENTS

| | | | |
|---|---|---|---|
| 1,549,871 | 8/1925 | Hatch | 4/217 |
| 1,997,695 | 4/1935 | Nielsen et al. | 4/213 |
| 3,120,665 | 2/1964 | Kirkland | 4/213 |
| 3,332,089 | 7/1967 | Wilton | 4/213 |
| 3,689,944 | 9/1972 | Clayton | 4/213 |
| 4,344,194 | 8/1982 | Pearson | 4/213 |
| 4,882,790 | 11/1989 | Ricard | 4/213 |

FOREIGN PATENT DOCUMENTS

| | | | |
|---|---|---|---|
| 2584752 | 1/1987 | France | 4/213 |
| 208157 | 1/1940 | Switzerland | 4/217 |

*Primary Examiner*—Henry J. Recla
*Assistant Examiner*—Robert M. Fetsuga

[57] ABSTRACT

A device for simple attachment to a water closet and tube extending to a location outside the building and room in which the closet is located. The device comprises a relatively small hollow housing having an opening for receiving gases when attached to the lid or seat of the closet, and an exit port and extension for connecting to the tube. The housing receives gases from the closet and directs the same from the housing to the tube and thus from the room and building. The gases are conveyed form the housing either by a motor driven fan or by normal convection currents.

1 Claim, 3 Drawing Sheets

SIMPLE LOW COST MEANS FOR VENTING A WATER CLOSET

BACKGROUND OF THE INVENTION

The present invention relates generally to water closets, and more particularly to a simple, low cost means for venting gases from a water closet that is also simple to install and sanitary.

The most common method for removing gases and odors from a bathroom area is the ceiling or wall fan, the fan includes a motor that is usually operable from a wall switch. Such fans require an opening to be made or provided in the ceiling or wall. The cost of these devices lie on the order of fifty dollars.

The problem with ceiling and wall fans is that they do not remove odors efficiently, as a return air duct in a bathroom heated and cooled by a central air system picks up the odors and circulates them in the building in which the return air duct and systems are located. In order to remove odors before being circulated by the central system, such fans would have to be located immediately adjacent the water closet.

U.S. Pat. No. 3,302,089 to Wilton shows a continuous duct fastened to the underside of a seat of a water closet and connected to a pipe located in a wall of a building. A second embodiment (FIG. 5) shows a circular duct 20*a* having a flange 22*a* that seats the duct on the rim of a bowl 12. A gasket 38 is attached to the underside of the seat to seal the seat against the upper edge of the bowl.

FIG. 6 of the Wilton patent shows an additional embodiment in which a resilient duct is attached to the underside of a seat and seats against the upper edge of the bowl to form a seal without the need of the above gasket.

A number of U.S. patents show devices located on the edge of a toilet bowl for removing gases. These devices generally are not easily removable for cleaning and, because of their low position and location on the bowl, are not particularly sanitary.

SUMMARY OF THE INVENTION

The present invention is directed to a very simple and inexpensive vent device for removing gases from a water closet such that return air ducts in systems employing centrally located air conditioning and heating units do not capture the gases and distribute them in the building housing the water closet. Rather, the device of the invention is simply attached to the lid or seat of a water closet and vented to the outside of the building such that gases in the water closet are quickly removed to the outside of the building. The device can be an inexpensive molded plastic housing provided with through holes for attaching the device to the lid or seat with wood screws. The housing has an output extension that is sized to connect to a hose or vent pipe that extends into the interior portion of a wall directly behind the water closet. The vent pipe either can descent to a crawl space beneath the building, with the odors removed by a small motor driven fan. The vent pipe can also extend upwardly in the wall and through the roof of the building so that the gases can be drawn from the water closet by normal convention currents without the use of a fan.

The subject embodiments are easily installed without professional help. In building new houses, the vent pipes can be located in the walls as the house is being constructed. For buildings already constructed, a flexible hose can be threaded beneath the bathroom. Small diameter, e.g., two inch flexible tubing is commercially available and inexpensive. In the case where the bathroom is situated over a basement, the flexible tubing can be threaded upwardly through the wall and vented into the attic of the building or through an outside wall. In both cases, normal convection currents will remove gases from the water closet without the use of a fan.

The plastic housing of the invention is small and inexpensive to make (mold) and is readily installed. In addition, the plastic housing is easily removed for cleaning. If the housing contains a fan and batteries, as shown in FIGS. 5 and 6, the cost may run from twenty to thirty dollars. Without a fan, the cost of the housing is negligible.

DESCRIPTION OF THE DRAWINGS

The invention, along with its objectives and advantages, will be better understood from consideration of the following detailed description and the accompanying drawings in which.

PREFERRED EMBODIMENTS

Figure 1:
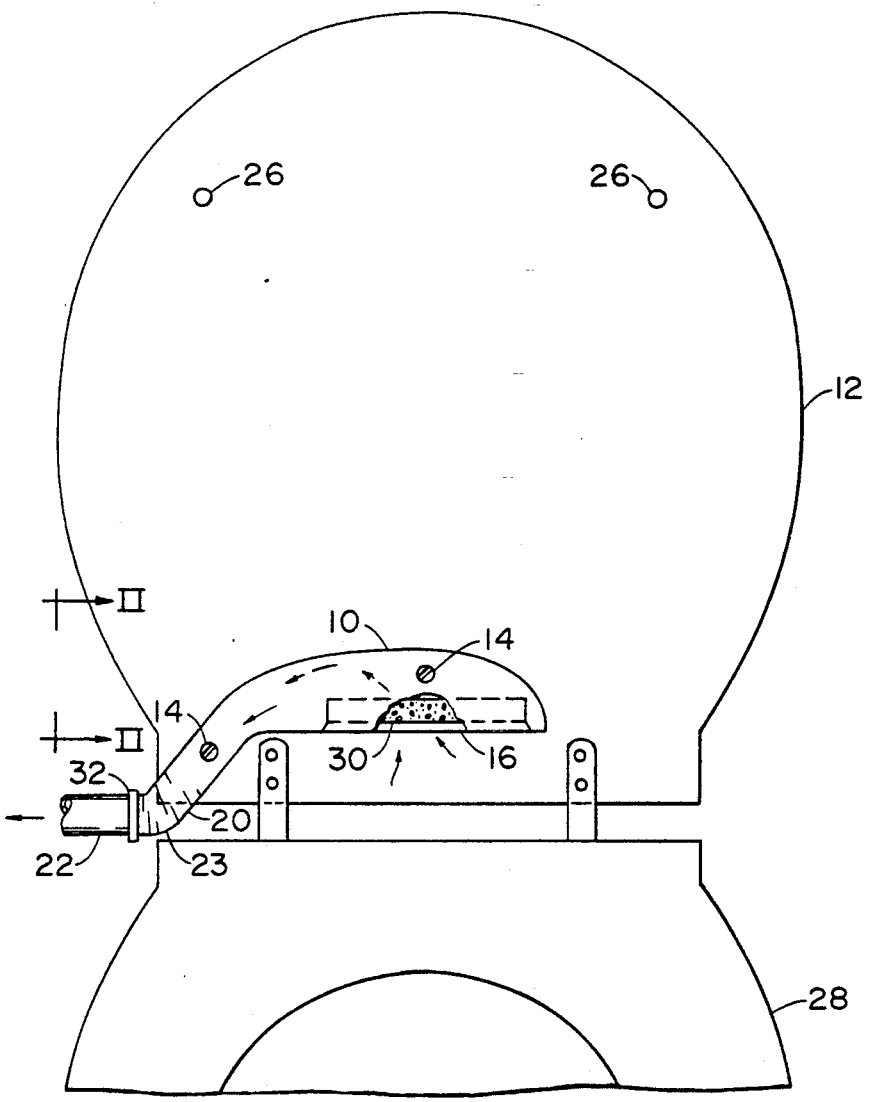
FIG. 1 is a front elevation view of the lid of a water closet having the vent housing of the invention attached thereto.

Referring now to FIG. 1 of the drawings, a simple hollow housing structure 10 is shown attached to a lid 12 of a bowl and water closet 13 (FIG. 3) by two screws 14. Housing 10 has an entrance opening 16 and outwardly angled lip 18 (FIG. 2) that serves to direct any liquids reaching the housing away from entrance 16. Housing 10 includes a hollow extension 20 (extending to the left in FIG. 1) that is connected to a vent pipe 22. A flexible hose section 23 can be used to connect extension 20 to pipe 22 if needed.

As seen in the drawings, lid 12 is provided with spacers 26 that provide a space between the lid and a seat 28. The thickness of extension 20 is such it is accommodated in space when spacers 26 rest on seat 28.

Pipe 22 preferably extends into a wall (not shown) located behind water closet 13. A second pipe (not shown) can extend upwardly in the wall and if such an internal pipe is not provided or available, a vertically descending pipe can be located to extend downwardly and exit into a crawl space (not shown) beneath the room containing the water closet. Or, if a basement area is located beneath the bathroom, the pipe can extend through an outside wall of the basement to vent gases from the water closet. In the case of a vertically rising pipe, a power driven fan is not needed, as the gases will vent upwardly with natural convection currents. If a vertically descending pipe is used, a small inexpensive motor driven fan can be provided and connected to the pipe at an appropriate location to pull the gases downwardly and into the crawl space. A suitable place to locate the fan for such a pipe would be in the crawl space or basement.

As shown by the arrows in FIG. 1, when convection currents or a fan is employed to remove gases from the vicinity of bowl 13, the gases enter into housing 10 through opening 16 and through a filter 30, if provided, and then outwardly through extension 20 of the housing. In this manner, a simple housing 10 is employed to remove gases from the area of a water closet without a substantial expense and one that can be easily installed by attaching the housing to lid 12 by screws 14.

Figure 2:
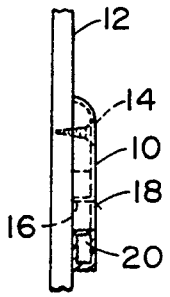
FIG. 2 is a side elevation view of the housing in FIG. 1 taken along lines II—II in FIG. 1.
Figure 2A:
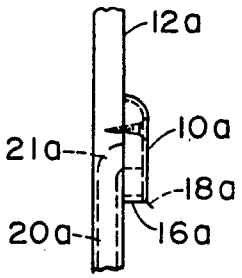
FIG. 2*a* is an alternative way of venting the housing of FIGS. 1 and 2.

FIG. 2*a* shows an alternative means to vent housing 10 (10*a*). In FIG. 2*a*, the lid is provided with a hollow portion 20*a*, with housing 10*a* being directly mounted over an entrance port 21*a* of 20*a*. An exit port and housing extension (not shown) can be connected to a vent pipe 22 and 23.

Figure 3:
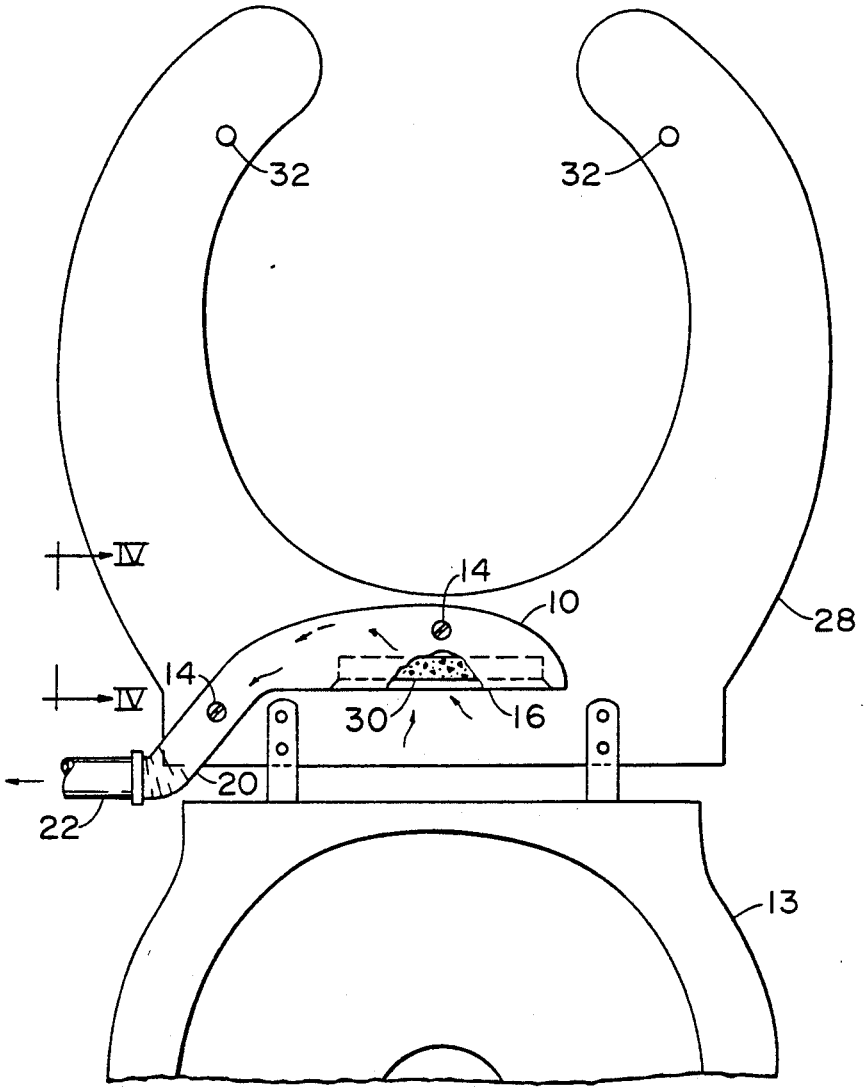
FIG. 3 is a front elevation view of the housing of the invention attached to the underside of a seat of a water closet.
Figure 4:
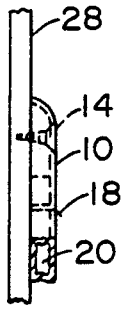
FIG. 4 is a side elevation view of the housing and lid of FIG. 3 taken along lines IV—IV in FIG. 3.

FIGS. 3 and 4 of the drawings show an arrangement similar to that of FIGS. 1 and 2, except that the housing 10 is connected to the under and lower side of seat 28. Again, the thickness of the exit port 20, as shown in FIG. 4, is such that the port will fit in the space between the seat and the top of bowl 13 that is provided by spacers 32 located on the underside of the seat.

Figure 4A:
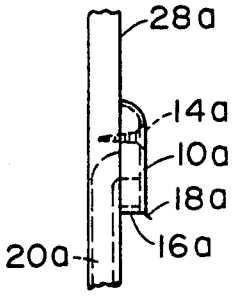
FIG. 4*a* is an alternative venting construction for the arrangement of FIGS. 3 and 4.

FIG. 4*a* shows a construction similar to that of FIG. 2*a*, the seat here being provided with a hollow portion 20*a* that is connected in the manner described above in connection with FIG. 2*a*.

Figure 5:
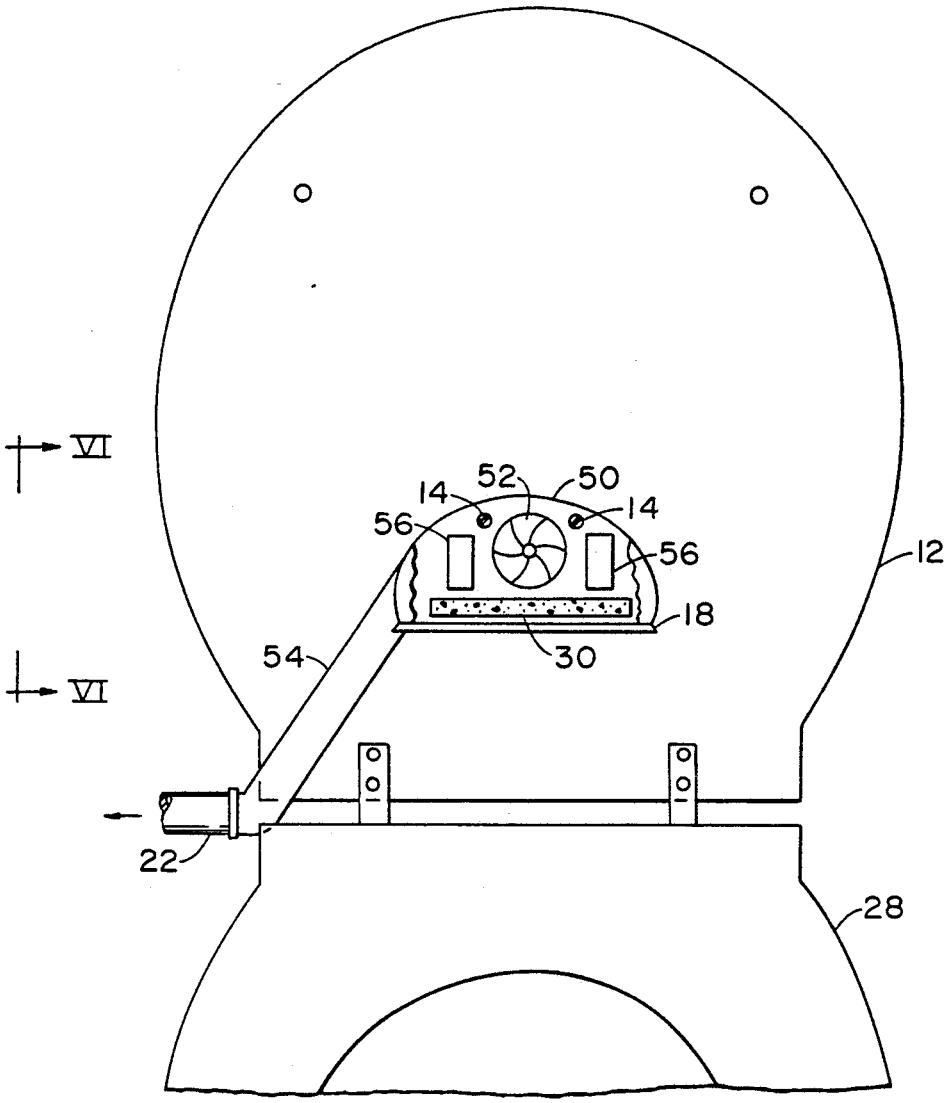
FIG. 5 is an elevation view of yet another embodiment of the invention in which the plastic housing contains a motor driven fan.
Figure 6:
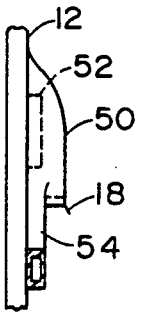
FIG. 6 is a side elevation view of the housing of FIG. 7 taken along lines VI—VI in FIG. 5.

FIGS. 5 and 6 of the drawings show a hollow housing structure 50 provided internally with a power driven fan 52. The motor of the fan is powered by two batteries 56 located in the housing. A simple on/off switch (not shown) can be employed and mounted in the wall of housing 50 so that the user can operate the fan when needed. The use of batteries provides a source of low voltage that is not in any way dangerous to the user.

The sizes of the housings 10 and 50 are such that they enter the openings of seat 28 and bowl 13 when the lid or seat is rotated forwardly to rest on bowl 13.

Figure 6A:
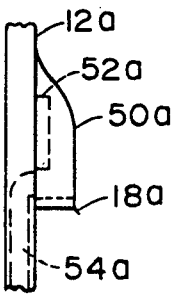
FIG. 6*a* is an alternative system of venting the housing of FIGS. 5 and 6.

FIG. 6*a* shows (again) the hollow interior of a housing 50*a* seated over the open end of a hollow portion 54*a* provided in a lid 12*a*.

From the above description it is readily apparent that a very simple and inexpensive device is provided for removing gases from a water closet. The vent housing is easily attached to and removable from the lid or seat of a water closet.

What is claimed is:

1. A. Apparatus for removing gases from a water closet having a lid and seat, and directing the same from the closet to the exterior of the building in which the closet is located, comprising:

a lid and seat located on the bowl of the water closet, a relatively small hollow housing attached to the underside of the lid and of a size that easily fits into the open center of the seat of the water closet when the lid is lowered on the seat, filter means located in said housing, a pipe directed to the exterior of the building, a tube having one end connected in fluid communication with the interior of the hollow housing, and an opposite end connected to said pipe directed to the exterior to the building, and means for withdrawing gases from the water closet and from the room in which it is located by withdrawing gases through said housing and filter, and directing the gases to said pipe that is directed to the exterior of the building.

* * * * *